United States Patent [19]

Wilson et al.

[11] 4,141,256

[45] Feb. 27, 1979

[54] TWO-SPEED INERTIA MOTOR

[75] Inventors: Nicol S. Wilson, Redondo Beach; Gary L. Hunter, Huntington Beach; Derek J. Gay, Rancho Palos Verdes, all of Calif.

[73] Assignee: Mattel, Inc., Hawthorne, Calif.

[21] Appl. No.: 764,221

[22] Filed: Jan. 17, 1977

[51] Int. Cl.[2] ..... F16H 32/02

[52] U.S. Cl. ..... 74/64; 74/329; 46/209

[58] Field of Search ..... 74/329, 64; 46/209

[56] References Cited

U.S. PATENT DOCUMENTS

| | | | |
|---|---|---|---|
| 748,334 | 12/1903 | Apple | 74/329 |
| 3,698,129 | 10/1972 | Lemelson | 46/209 |
| 3,968,593 | 7/1976 | Lin | 46/209 |

*Primary Examiner*—Benjamin W. Wyche
*Assistant Examiner*—Wesley S. Ratliff, Jr.
*Attorney, Agent, or Firm*—John G. Mesaros; Max E. Shirk; Ronald M. Goldman

[57] ABSTRACT

A two-speed inertia motor having a pair of wheels secured to a common axis, one of the wheels being a drive wheel and having a gear portion coaxial therewith for selectively coupling to an inertia wheel through a first or second gear member for providing two-speed ratios between the rotation of the drive wheel and the inertia wheel. A main gear member is coupled to the drive wheel, the main gear member having a splined shaft portion for slidably receiving a clutch member for concurrent rotation therewith, the first and second gear members being freely rotatable on either side of said clutch member. Means are provided for shifting the clutch member into locking engagement with either the first gear member or the second gear member to secure the so-locked gear member into direct coupling relation between the drive wheel and the inertia wheel. The drive gear is coupled to the drive wheel to provide slippage therebetween in the event of successive torque being applied to the drive wheel to energize the inertia motor.

9 Claims, 6 Drawing Figures

TWO-SPEED INERTIA MOTOR

BACKGROUND OF THE INVENTION

The background of the invention will be discussed in two parts:

FIELD OF THE INVENTION

This invention relates to inertia motors and more particularly to an inertia powered motor module capable of providing two-speed ratios.

DESCRIPTION OF THE PRIOR ART

Inertia powered motors in toy vehicles are generally very popular and various structural arrangements for such motors have been employed, some such arrangements being shown in U.S. Pat. Nos. 806,977; 1,161,812; 2,708,811 and 3,698,129. Toy vehicles containing such inertia motors are usually energized by the user pressing the vehicle against a surface to accelerate the inertia wheel by repeated sweeping strokes of the drive wheel of the vehicle on the surface. Upon reaching the desired speed of rotation of the inertia wheel the vehicle is then placed on the surface to operate under the power of the inertia wheel.

U.S. Pat. No. 1,161,812 provides an alternate method for energizing the inertia wheel by utilizing a spring-biased hand-rotatable friction disc which can be utilized to drive the inertia wheel by selective engagement with either the wheel or the shaft to which the inertia wheel is affixed.

U.S. Pat. No. 3,698,129 discloses an alternate method for energizing the inertia wheel by utilizing a gear strip coacting with a gear within the vehicle coupled to the inertia wheel.

U.S. Pat. No. 2,708,811 shows an inertia motor having a gear with teeth about the periphery thereof selectively engaged by one of two pinion gears for providing reversable movement of the drive wheel under control of an inertia wheel rotating in a given direction.

The inertia wheel motors shown in the above-identified patents all provide one-speed ratio between the rotating flywheel or inertia wheel and the drive wheel of the vehicle which is coupled thereto.

Accordingly it is an object of this invention to provide a new and improved inertia motor which provides two-speed ratios for the vehicle with which it is associated.

It is another object of this invention to provide a new and improved inertia motor having a clutch member selectively actuable by an operator to provide speed or power to the vehicle.

It is a further object of the invention to provide a new and improved inertia motor having a clutch member and drive wheel configured to absorb shock during the operation thereof.

SUMMARY OF THE INVENTION

The foregoing and other objects of the invention are accomplished by providing an inertia motor having an inertia wheel rotatably mounted on an axle with a main gear member rotatably mounted on the same axle. The main gear member is provided with a splined or square shaft portion slidably receiving a clutch member for concurrent rotation therewith. The first and second gears are rotatably mounted with respect to the same axle, such gears having different gear diameters, the clutch member being slided into locking engagement with one or the other of said gear members by means of a shift fork operable externally of the module. The clutch member is provided with two clutch discs on either side of a central journal portion, each clutch disc and the adjacent surface of the gear adapted to coact therewith being configured for selective locking engagement upon movement of the clutch member toward the gear. Other gear means couple the inertia wheel to the drive wheel through the so-selected gear. The drive wheel is configured for slipping engagement with respect to the drive gear thereof to absorb shock if excessive torque is applied to the drive wheel during engagement with a surface for energizing the inertia motor.

Other objects, features and advantages of the invention will become apparent from the reading of the specification when taken in conjunction with the drawings in which like reference numerals refer to like elements in the several views.

DESCRIPTION OF THE PREFERRED EMBODIMENT

Figure 1:
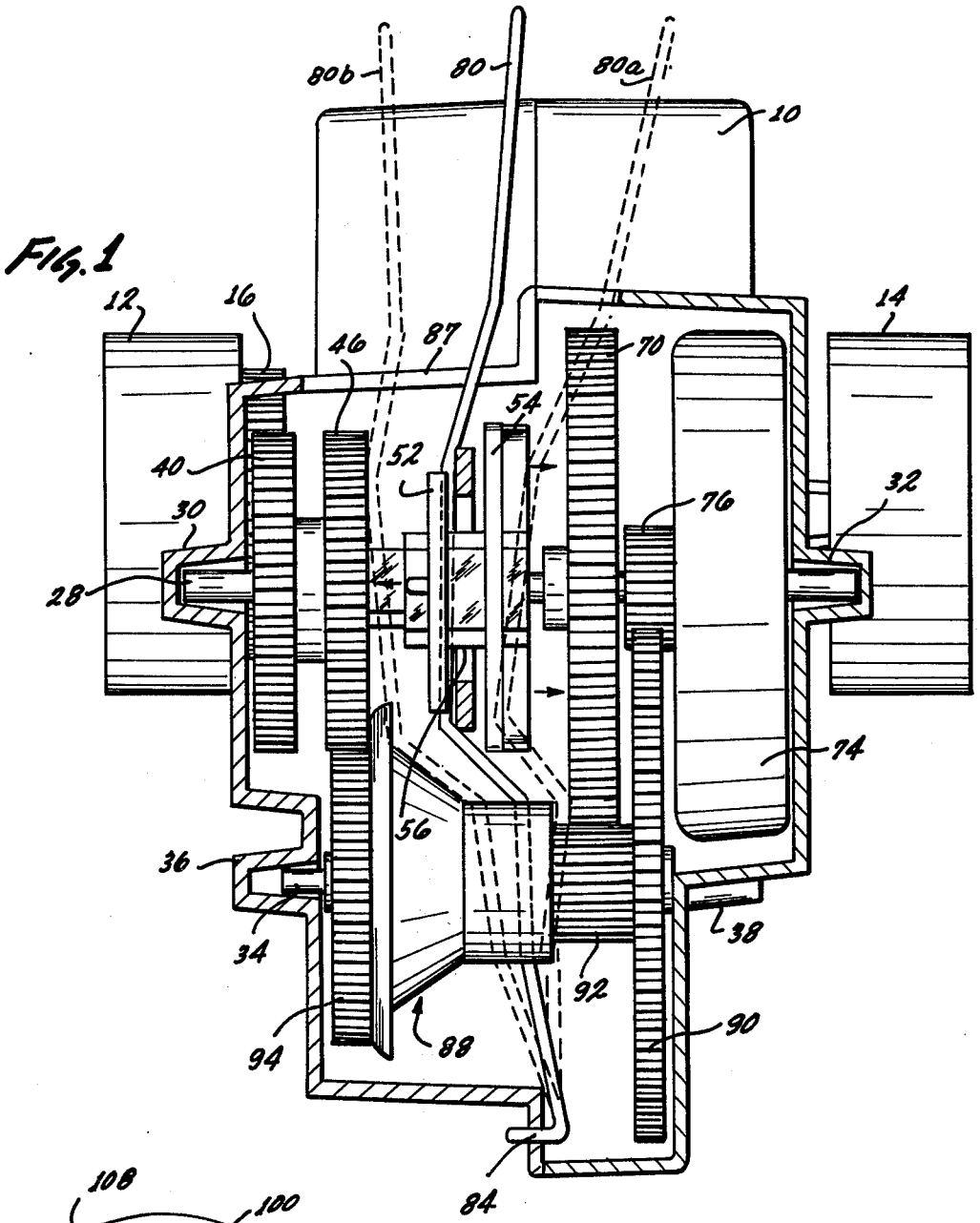
FIG. 1 is a top plan view, partially in cross section, of the two-speed inertia motor according to the invention.
Figure 2:
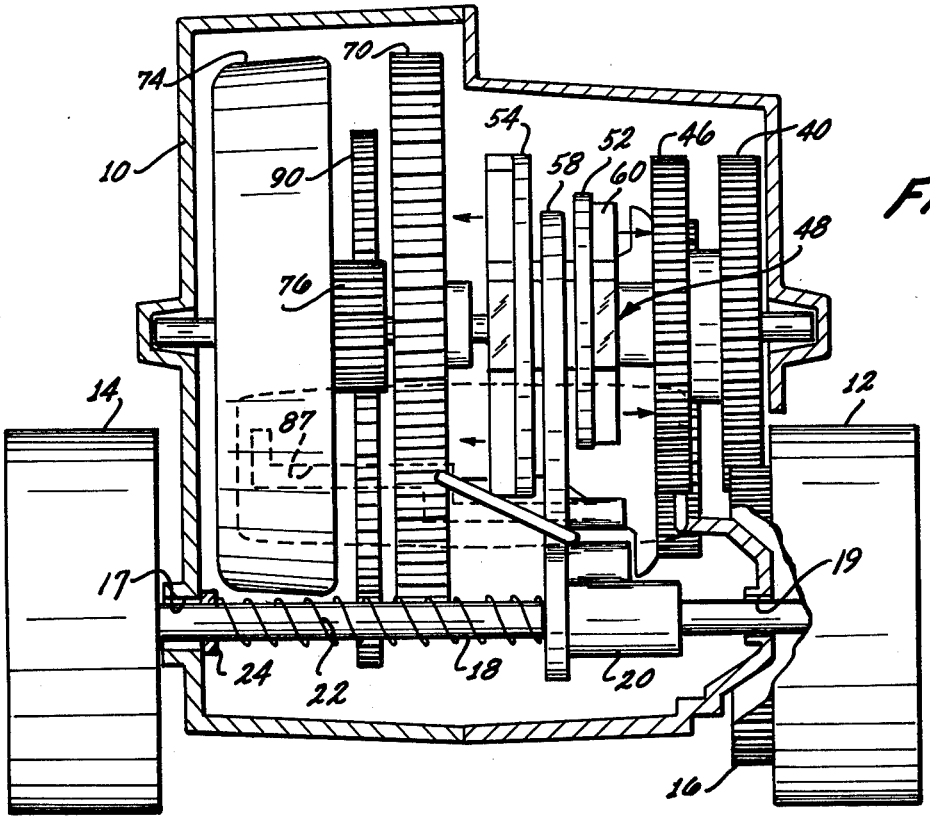
FIG. 2 is a rear end view, partially in cross section, of the two-speed inertia motor of FIG. 1.
Figure 3:
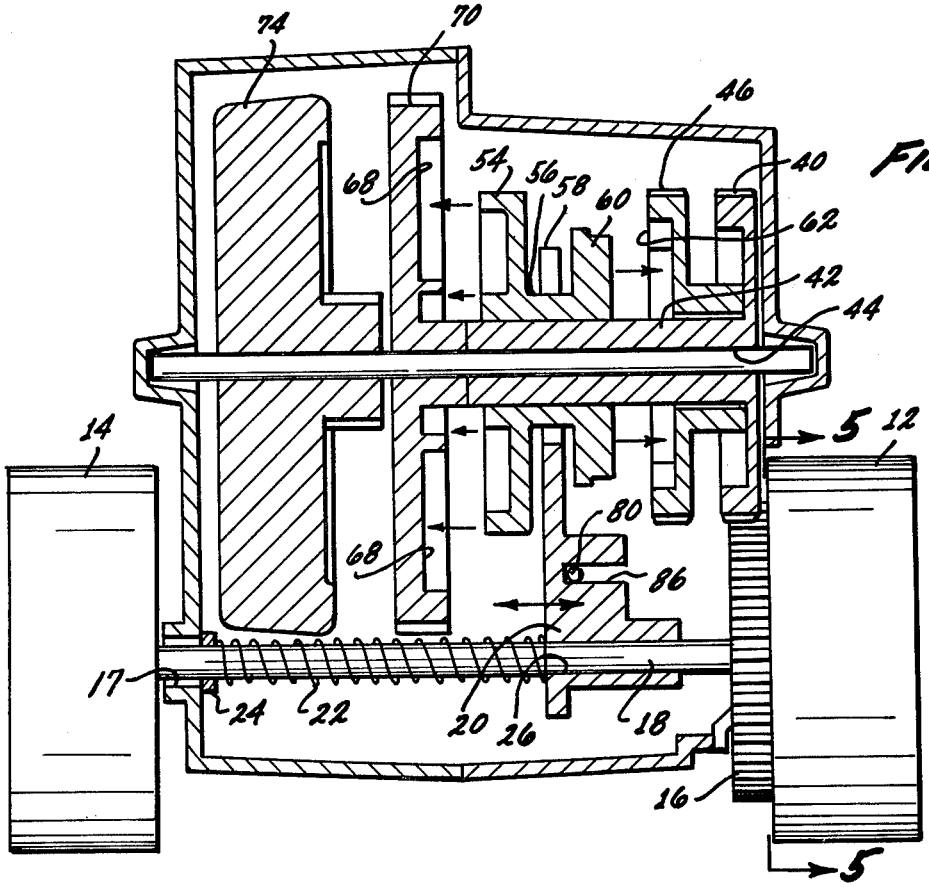
FIG. 3 is a cross sectional view similar to FIG. 2.

Referring now to the drawings and particularly to FIG. 1, there is shown a two-speed inertia powered motor module for incorporation in a toy vehicle, the module including a housing or supporting structure 10 which has rotatably secured thereto a drive wheel 12 and coaxial therewith a free-wheeling second wheel 14, both wheels being adapted for rollingly engaging a surface. As can be seen in FIGS. 2 and 3, the drive wheel is coaxial with a drive gear 16, the two coacting in a slipping manner as will hereinafter be explained. Drive gear 16 is rotatably received about an axle 18 which has the other end thereof rotatably receiving the free-wheeling wheel 14. The axle 18 is suitably retained on supporting structure 10 by bearing apertures 17 and 19. Slidably positioned for movement on axle 18 is a shift fork member 20 biased to the right as viewed in FIGS. 2 and 3 by means of a bias spring 22 encircling axle 18 with the left end of spring 22 abutting against the adjacent surface or a suitable washer member 24 and the right end thereof abutting against the surface of shift fork member 20 adjacent aperture 26 through which axle 18 extends.

Referring again to FIG. 1, the motor assembly includes a second axle 28 mounted in bearing projections 30 and 32 formed in supporting structure 10. The axle 28 is horizontal and parallel to axle 18 but positioned thereabove to accomodate various components thereon. Positioned forwardly of axle 28 and parallel thereto is a third shaft or axle 34 suitably retained in supporting structure 10 in journals 36 and 38 formed integrally with structure 10.

Figure 4:
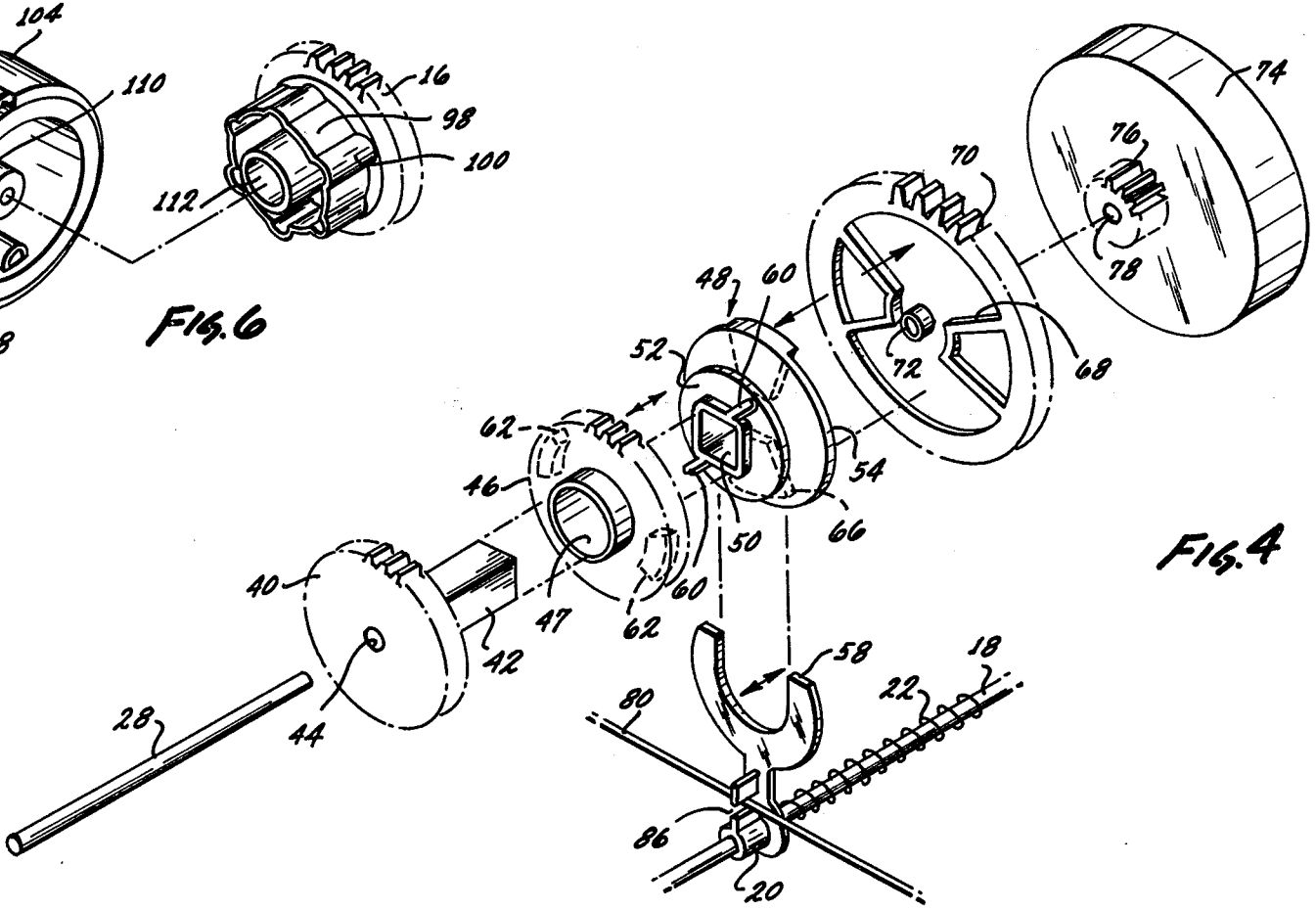
FIG. 4 is an exploded perspective view of the shifting mechanism utilized in the motor of FIG. 1.

Axle 28 is mounted thereon the main drive and speed shifting components which include a main gear member 40 (see also FIG. 4) which has a medium diameter gear in meshing engagement with drive gear 16, the main gear member 40 having integral therewith a non-circular splined or square shaft 42, the splined shaft 42 having an aperture 44 through which extends axle 28. Positioned over splined shaft 42 is a free-wheeling "high" gear member 46 having an inner circular aperture 47, the diameter of which is slightly larger than the diagonal distance between opposite corners of the square cross section of shaft 42. The high gear 46 freely rotates about shaft 42 unless engaged as will hereinafter be discussed. Positioned next on shaft 42 is a clutch member 48 which has a splined or square aperture 50 received on shaft 52 for concurrent rotation therewith, although clutch member 48 is slidable along shaft 52.

The clutch member 48 is essentially two parallel discs, these being a small diameter disc 52 and a large diameter disc 54 interconnected by a cylindrical journal 56. Journal 56 is engaged by the shift fork member 20 which has an upwardly extending U-shaped fork portion 58 configured to partially encircle the journal 56 with the broad opposing surfaces of fork portion 58 being adapted to abut against the inner surface of disc 52 or disc 54 to move clutch member 48 in either direction on shaft 42 as indicated by the double-ended arrow adjacent thereto. The surface of disc 52 adjacent high gear 46 is provided with a pair of outwardly extending generally diametrically opposed integral shoulder portions 60. Shoulders 60 are adapted to selectively engage a pair of diametrically opposed arcuate segments 62 outwardly extending from the adjacent side surface of high gear 62.

Formed integrally with the outer surface of disc 54 of clutch member 48 is a pair of diametrically opposed wedge-shaped projections 66 adapted to selectively engage wedge-shaped recesses 68 formed in the side surface of a "low" gear member 70 which is rotatably received on shaft 28 by means of a centrally disposed aperture 72 therein. Also rotatably mounted on axle 28 is an inertia wheel 74 having a small diameter pinion gear 76 integral therewith with an aperture 78 extending therethrough to receive axle 28. None of the components mounted on axle 28 is secured thereto but, as will hereinafter be described, a clutch member 48 when suitably shifted by means of a flexible wire shift lever 80 will engage either the high gear 46 or the low gear 70 to "lock" one of these two gears for rotation with main gear member 40 to provide one of two speeds for the inertia motor module. As can be seen the high gear member 46 is a smaller diameter gear than the low gear member 70 with the clutch discs 52 and 54 respectively, having diameters corresponding to the adjacent gear surface with which it is to coact. The peripheral spacing between arcuate segments 62 on high gear 46 is relatively large compared to the peripheral length of segments 62. The shoulders 60 which coact therewith in a circunferential direction are relatively small in dimension to allow a large tolerance to insure that the shoulders 60 abut against the edges of arcuate segments 62 in the event shifting is effected with the inertia wheel 74 moving. Similarly with respect to the wedge-shaped projections 66 on clutch disc 54, the angle defining the opposite edges of the projections 66 is much smaller than the angle defining the engaging edges of the wedge-shaped recesses of low gear 70.

Referring again to FIG. 1, the shift lever 80 is pivotally secured to supporting structure 10 at one end thereof by means of a bent portion 84 being inserted through a suitable aperture. The shift lever 80 is suitably configured to accommodate the components within the supporting structure 10 and passes through a recess 86 formed in shift fork member 20 on the side opposite bias spring 22, the shifting being accomplished by moving shift lever 80 against the force of bias spring 22 to thereby slide shift fork member 20 on axle 18. The free end of shift lever 80 extends out through a slot 87 (shown in solid lines within a dotted line segment of FIG. 2) formed in supporting structure 10 and can be shifted in slot 87 to the right-hand dotted line position designated 80*a* which would correspond to the "low" gear position wherein clutch member 48 has clutch disc 54 thereof engaging low gear 70 with wedge-shaped projections 66 fitting within wedge-shaped recesses 68 of low gear 70. By shifting to the left-hand dotted line position designated 80*b* clutch disc 52 would have the shoulders 60 thereof abutting against the edges of arcuate segments 62 of high gear 46 thus placing the inertia motor module in "high" gear. The bias spring 22 is configured to normally urge shift fork member 20 to the dotted line position of shift lever 80, designated 80*b*, that being with clutch disc 52 engaging high gear 46. Shifting to the "neutral" or "low" gear positions of shift lever 80 designated 80 and 80*a*, respectively, is accomplished by moving shift lever 80 against the force of this bias to one of the two notched positions provided in slot 86.

A coupling gear member 88 is rotatably received on shaft 34, the coupling gear 88 having three integral gear portions, these being a large diameter gear 90 in meshing engagement with pinion gear 76 of inertia wheel 74; a pinion gear portion 92 in meshing engagement with low gear member 70 and a medium diameter gear portion 94 in meshing engagement with high gear 46.

With the shift lever 80 in the solid line position shown in FIG. 1, the inertia motor module is in "neutral", that is the clutch member 48 is intermediate gear members 46 and 70 and inertia wheel 74 is not coupled to main gear member 40 which meshes with drive gear 16 which engages drive wheel 12. In this position, with the module connected to a vehicle if the vehicle is moved in contact with a surface the drive wheel 12 which carries with it the drive wheel 16 will rotate main gear member 40. If inertia wheel 74 is not rotating coupling gear 88 will be stationary due to its direct coupling to inertia wheel 74 through pinion gear 76 thereof. Since low gear 70 is mounted upon axle 28 and is directly coupled to coupling gear 88, it, likewise, will not be moving. Furthermore, since high gear 46 is free to rotate with respect to the splined shaft 42 of main gear member 40 it, likewise, being directly coupled to coupling gear 88, will not be rotating. Alternatively, if inertia wheel 74 were rotating, coupling gear 88 will be rotating at a speed determined by the ratio of the number of teeth of large diameter gear portion 90 thereof with respect to the number of teeth in pinion gear 76. However, since both high gear 46 and low gear 70 are direct coupled to coupling gear 88, both of these gears would likewise be moving, but, since neither one is secured for movement with respect to main gear member 40 the operation of drive wheel 12 would be completely independent of the speed of the inertia wheel 74.

If at this point, the shift lever 80 is moved to the low gear position designated by dotted line 80*a* the clutch member 48 would be moved to the right until the wedge-shaped projections 66 of clutch disc 54 fit within recesses 68 of the adjacent surface of low gear 70 thereby locking low gear 70 to the splined shaft 42 of main gear member 40. The overall length of aperture 50 of clutch member 48 slidably engaging splined shaft 42 is such that clutch member 48 remains in engagement at all times with splined shaft 42 to provide concurrent rotation of clutch member 48 with main gear member 40. In this condition, with inertia wheel 74 rotating the main gear member 40 is direct coupled to inertia wheel 74 through pinion gear 76, through large diameter gear portion 90 and pinion gear portion 92 of coupling gear 88 through low gear 70 through main gear member 40 through drive gear 16 to drive wheel 12, thus rotating drive wheel 12 at a speed determined by the gear ratios in the direct coupling path.

Similarly if shift lever 80 is shifted to the "high" gear position designated **80*b* in dotted lines, the clutch disc 52 will have the shoulders 60 thereof urging aganst the edges of arcuate segments 62 of high gear 46 thereby resulting in the inertia wheel 74 being direct coupled to the splined shaft 42 of main gear member 40 through pinion gear 76 through large diameter gear portion 90 and medium diameter gear portion 94 of coupling gear 88, through high gear 46 through main gear member 40 through drive gear 16 to drive wheel 12. For the use of the module the shift lever 80 is moved to either high or low gear position and the vehicle carrying the module is then repeatedly moved over a surface so that drive wheel 12 engages the surface to thereby drive inertia wheel 74. If the operator selects the "high" gear position to start inertia wheel 74 and thereafter desires to shift to "low" gear to get more power, the flexibility of the shift lever 80 permits the user to move the shift lever 80 to the notched position within slot 86 corresponding to low gear even though the wedge-shaped projections 66 do not immediately fall within wedge-shaped recesses 68. When this occurs the lever 80, being resilient urges the clutch member 48 toward low gear 70 (which is initially stationary) so that ultimately the projections 66 will fall into wedge-shaped recesses 68 to thereby lock low gear 70 for concurrent movement with main drive gear member 40. Similarly due to the resilience of bias spring 22 when the operator shifts from low gear to high gear with inertia wheel 74 rotating bias spring 22 urges moving clutch member 48 into engagement with high gear 46**.

Figure 5:
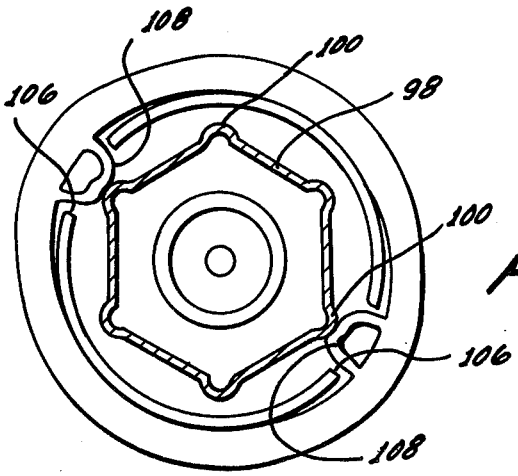
FIG. 5 is a cross sectional view of the drive wheel taken generally along line 5—5 of FIG. 3.
Figure 6:
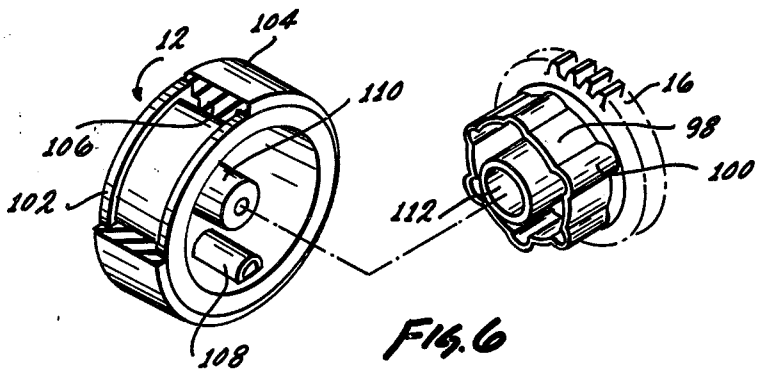
FIG. 6 is an exploded perspective view, partially in cross section, of the drive wheel assembly.

To further prevent shock to the system, since the inertia wheel selected is a relatively large rotating mass, referring to FIGS. 5 and 6 the construction of drive wheel 12 is adapted to prevent abuse and to absorb shock. The construction includes the drive gear 16 having a hub portion 98 with a plurality of axially disposed, outwardly extending protuberances 100. The drive wheel 12 includes a rim 102 receiving a tire 104, the rim 102 being suitably configured for receiving the tire 104 and having a pair of diametrically opposed slots 106 through which pass inwardly extending ridge portions 108 of tire 104 through the inner surface of rim 102. The rim 102 is provided with a centrally disposed hub 110 which fits within an enlarged aperture 112 of hub 98. As can be seen in FIG. 5 the maximum dimension between protuberances 100 is such that they normally abut against ridge members 108 of tire 104 while permitting tire 104 to be deformed outwardly to thereby provide a certain amount of slippage between hub 98 and rim 102 of drive wheel 12. Consequently, during initial start up to rotate inertia wheel 74, if the operator pushes the vehicle beyond the capability of the inertia wheel to react, the ridge members 108 of tire 104 will deform over protuberances 100 of hub 98 thereby preventing damage to the components and preventing shock to the system. As the inertia wheel 74 picks up speed the slippage between hub 98 and rim 102 of drive wheel 12 will decrease to zero thereby creating a positive coupling between hub 98 and drive wheel 12.

Thus there has been shown and described an inertia motor having a neutral position and a shift lever operable to put the motor into high gear for speed or low gear for power by means of a clutch member selectively operable to lock a low gear or a high gear for concurrent rotation with the main gear member which is directly coupled to the drive wheel. A resilient biasing spring urges the shift fork which coacts with the clutch member in a first direction to engage a clutch disc with a "high" gear, the shift fork being operable aganst the force of the bias by means of a flexible wire spring shift lever to permit engagement of the other clutch disc with the other gear. The speed ratio is determined by the proper selection of gear teeth for the high gear or low gear members along with the number of gear teeth in the coupling gear. Each clutch disc has the engaging portion thereof small in proportion to the available engaged portion of the surface of the coacting gear to permit positive engagement regardless of the point in time when the engaging surfaces coact. The bias spring and the flexible shift lever urge the parts together to permit proper engagement should it not be effected immediately. While there has been shown and described a preferred embodiment, it is to be understood that various other adaptations and modifications may be made within the spirit and scope of the invention.

What is claimed is:

1. In a power module for driving a toy vehicle or the like, the combination comprising:

a supporting structure;

a first axle supported by said structure and having at least one drive wheel affixed thereto, said drive wheel having a coaxial drive gear member coacting therewith;

a second axle mounted within said structure;

an inertia wheel rotatably mounted on said second axle;

a main gear member rotatably mounted on said second axle and having a gear portion and a splined shaft portion, said gear portion meshingly engaging said drive gear member;

a first gear member rotatably mounted on said second axle;

a second gear member mounted on said splined shaft portion and rotatable relative thereto;

a clutch member axially slidably mounted on said splined shaft portion for concurrent rotation therewith, said clutch member being positioned intermediate said first and second gear members, said clutch member including a first and second clutch discs interconnected by a journal portion;

a shift fork coacting with said journal portion to selectively slide said clutch member on said splined shaft portion for selectively coupling either of first and second gear members for rotation with said drive gear member; and other gear means coupling said inertia wheel to drive said drive gear member through said so-selected first and second gear members.

2. The combination according to claim 1 wherein the adjacent surfaces of each of said first and second gear members and each of said clutch discs are configured for mating engagement to lock the so-selected first and second gear members for concurrent rotation with said clutch member and said main gear member.

3. The combination according to claim 2 wherein said shift fork is mounted for slidable movement on said first axle.

4. The combination according to claim 3 wherein said shift fork is biased on said first axle toward one of said wheels.

5. In an inertia motor for driving a toy vehicle or the like, the combination comprising:

a supporting structure;

an inertia wheel rotatably mounted within said structure;

at least one drive wheel rotatably mounted on said structure, said drive wheel having a coaxial drive gear member coacting therewith;

an axle supported by said structure;

a first gear member rotatably mounted on said axle;

a main gear member rotatably mounted on said axle and having a gear portion and a splined shaft portion extending toward said first gear member;

a second gear member mounted on said splined shaft portion and rotatable relative thereto;

a clutch member axially slidably mounted on said splined shaft portion intermediate said first and second gear members for concurrent rotation with said main gear member, said clutch member including a first and second clutch discs interconnected by a journal portion;

a shift fork coacting within said journal portion for selectively coupling one of said first and second clutch discs to one of said first and second gear members for rotation with said main gear member; and other gear means coupling said inertia wheel to drive said drive gear member through said so-selected first and second gear members.

6. The combination according to claim 5 wherein said first and second gear members provide different gear ratios between said inertia wheel and said drive gear member.

7. The combination according to claim 6 wherein said clutch member is dimensioned to enable said shift fork to be manually operated to a position with both of said first and second clutch members being disengaged from both of said first and second gear members.

8. The combination according to claim 7 wherein said drive wheel is mounted for rotation on an axle and said shift fork is axially slidably mounted on said wheel axle.

9. The combination according to claim 8 further including a coil spring encircling said wheel axle with one end of said spring engaging said shift fork for biasing said shift fork in a first direction.

* * * * *